US006552497B2

(12) United States Patent
Nakagawa et al.

(10) Patent No.: US 6,552,497 B2
(45) Date of Patent: Apr. 22, 2003

(54) LIGHT BULB TYPE FLUORESCENT LAMP LIGHTING APPARATUS

(75) Inventors: Hiroki Nakagawa, Osaka (JP); Tetsuya Tahara, Shiga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/881,355

(22) Filed: Jun. 14, 2001

(65) Prior Publication Data

US 2002/0030452 A1 Mar. 14, 2002

(30) Foreign Application Priority Data

Jun. 14, 2000 (JP) ..... 2000-179179

(51) Int. Cl.[7] ..... H05B 37/02
(52) U.S. Cl. ..... 315/209 R; 315/169.3
(58) Field of Search ..... 315/209 R, 94, 315/98, 99, 106, 107, 225, 246, 46, 116, 169.3

(56) References Cited

U.S. PATENT DOCUMENTS 5,612,597 A * 3/1997 Wood ..... 315/209 R
5,932,974 A * 8/1999 Wood ..... 315/106
5,961,204 A 10/1999 Martich et al. ..... 362/295
6,107,747 A * 8/2000 Hakata et al. ..... 315/209 R
6,252,357 B1 * 6/2001 Tanaka et al. ..... 315/209 R

FOREIGN PATENT DOCUMENTS

EP 0 954 207 A2 3/1999
JP 62126596 6/1997

* cited by examiner

*Primary Examiner*—Hoanganh Le
*Assistant Examiner*—Chuc D Tran
(74) *Attorney, Agent, or Firm*—Snell & Wilmer, LLP

(57) ABSTRACT

A light bulb type fluorescent lamp lighting apparatus includes a fluorescent light emitting tube; and an electronic lighting circuit for applying an electric current to the fluorescent light emitting tube. The electronic lighting circuit includes a pair of electrode filaments provided in the fluorescent light emitting tube, a capacitor connected parallel to the fluorescent light emitting tube, an inductor connected in series to one of the pair of electrode filaments, and at least one temperature negative characteristic resistance element connected parallel to at least one of the pair of electrode filaments. The at least one temperature negative characteristic resistance element has a resistance impedance, and the fluorescent light emitting tube is started based on a change in the resistance impedance of the at least one temperature negative characteristic resistance element.

8 Claims, 5 Drawing Sheets

LIGHT BULB TYPE FLUORESCENT LAMP LIGHTING APPARATUS

BACKGROUND OF THE INVENTION

1. Field of the Invention

The present invention relates to alight bulb type fluorescent lamp lighting apparatus for lighting up a fluorescent light emitting tube using a high frequency inverter type electronic lighting circuit.

2. Description of the Related Art

In recent years, as energy savings have become more and more important, an increasing number of fluorescent lamp light apparatuses have adopted a high frequency inverter type electronic lighting circuit, instead of a copper-iron stabilizer as conventionally used. Specifically for a light bulb type fluorescent lamp built in the lighting apparatus as an energy-saving light source replacing a light bulb, the use of this type of electronic lighting circuits is becoming more common in order to realize a lamp having a higher lamp efficiency or light emission efficiency.

In order to improve the lamp efficiency of the electronic lighting circuit for a light bulb type fluorescent lamp, there has been an attempt to improve the circuit conversion efficiency of the electronic lighting circuit. As a result, the circuit conversion efficiency which was about 80% has been increased to a maximum of about 92%. This has been realized by introducing a series inverter circuit system in an electronic light circuit or by using a MOS field emission power transistor as an electronic component. The value of about 92% is almost the maximum possible value for circuit conversion efficiency. In order to further improve the lamp efficiency, a different new technique, for example, a technique for reducing a power loss caused by heat generation in an electrode filament coil in the fluorescent light emitting tube is demanded.

FIG. 4 is a diagram illustrating a basic structure of a conventional high frequency inverter type electronic lighting circuit 119 (hereinafter, referred to simply as the "electronic lighting circuit 119"). The electronic lighting circuit 119 includes an inverter circuit section 125 which is driven by a commercial power supply 113. The inverter circuit section 125 lights up a fluorescent light emitting tube 120.

The fluorescent light emitting tube 120 includes a pair of electrode filament coils 121 and 122. The electrode filament coil 121 includes terminals 121*a* and 121*b*, and the electrode filament coil 122 includes terminals 122*a* and 122*b*. The terminals 121*a* and 122*a* are closer than the terminals 121*b* and 122*b* to the power supply 113 for applying an electric current to the fluorescent light emitting tube 120.

The terminal 122*a* of the electrode filament coil 122 is directly connected to the inverter circuit section 125. The terminal 121*a* of the electrode filament coil 121 is connected to the inverter circuit section 125 via an inductor 124 provided for electric current control. The inductor 124 is connected in series to the terminal 121*a*. The terminals 121*b* and 122*b* of the electrode filament coils 121 and 122 are connected to each other via a capacitor 123. The capacitor 123 and the inductor 124 are included in a resonating circuit. In FIG. 4, an inductance of the inductor 124 is represented by "L", and a capacitance of the capacitor 123 is represented by "Cs".

The conventional electronic lighting circuit 119 performs an operation for starting and thus placing a fluorescent lamp into a constant lighting state, using a hot cathode starting system. This will be described below.

Before starting the lamp, the inverter circuit section 125 causes an electric current to flow to the electrode filament coils 121 and 122 of the fluorescent light emitting tube 120 through the capacitor 123 in order to pre-heat the electrode filament coils 121 and 122 and thus cause the electrode filament coils 121 and 122 to emit a sufficient amount of thermoelectrons. The capacitor 123 is connected parallel to the fluorescent light emitting tube 120.

When the pre-heating electric current is supplied to the electrode filament coils 121 and 122, a starting voltage is applied between the electrode filament coils 121 and 122 within about 1 second, and thus the fluorescent light emitting tube 120 is started. The starting voltage corresponds to a resonating voltage of the resonating circuit including the capacitor 123 and the inductor 124.

The fluorescent light emitting tube 120, after being started, goes into a constant lighting state. In this state, the electric current still flows to the electrode filament coils 121 and 122 via the capacitor 123, and thus heat is generated in the electrode filament coils 121 and 122.

As described above, the conventional electronic lighting circuit 119 realizes the constant lighting state of the fluorescent light emitting tube 120 after pre-heating the electrode filament coils 121 and 122 and then starting the fluorescent light emitting tube 120. After the fluorescent light emitting tube 120 goes into the constant lighting state, the electric current for heating the electrode filament coils 121 and 122 is basically unnecessary. However, since an electric current is required in order to pre-heat the electrode filament coils 121 and 122 by the conventional method, the electric current inevitably flows even after the fluorescent light emitting tube 120 goes into the constant lighting state and thus generates heat in the electrode filament coils 121 and 122. This heat generation causes a power loss.

In a currently-used light bulb type fluorescent lamp (for example, a 14 W or 25 W light bulb) which has a luminous flux corresponding to that of a general 60 W or 100 W light bulb, the power loss caused by the heat generation is 0.4 W to 0.5 W per electrode filament coil. In the fluorescent light emitting tube 120, the power loss caused by the heat generation is 0.8 W to 1.0 W per electrode filament coil. These values are not negligible.

FIGS. 5A through 5C show known electronic light circuits used for reducing such a power loss caused by the heat generation in an electrode filament coil during a constant light state of the fluorescent light emitting tube 120. Like elements as those in FIG. 4 bear identical reference numerals.

An electronic light circuit 119*a* shown in FIG. 5A adopts a so-called cold cathode starting system. The electrode filament coils 121 and 122 of the fluorescent light emitting tube 120 are respectively shortcircuited by leads 126 and 127. The leads 126 and 127 are respectively connected parallel to the electrode filament coils 121 and 122. The fluorescent light emitting tube 120 is started in a cold cathode state with no thermoelectrons being emitted. Due to such a structure, the power loss caused by the heat generation in the electrode filament coils 121 and 122 is reduced.

An electronic lighting circuit 119*b* shown in FIG. 5B is disclosed in Japanese Laid-Open Publication No. 10-199686. Diodes 128 and 129 are respectively connected parallel to the electrode filament coils 121 and 122 of the fluorescent light emitting tube 120. Due to such a structure, the amount of the electric current flowing to each of the electrode filament coils 121 and 122 is reduced to half. Thus, the power loss caused by the heat generation is also reduced to about half.

An electronic lighting circuit 119*c* shown in FIG. 5C is disclosed in Japanese Laid-Open Publication No. 5-13186. Capacitors 131 and 132 are respectively connected parallel to the electrode filament coils 121 and 122 of the fluorescent light emitting tube 120. The capacitor 131 branches the electric current into the capacitor 131 and the electrode filament coil 121, and the capacitor 132 branches the electric current into the capacitor 132 and the electrode filament coil 122. Due to such a structure also, the amount of the electric current flowing to each of the electrode filament coils 121 and 122 is reduced. Thus, the power loss caused by the heat generation is also reduced.

Fluorescent lamps are now expected to be used in houses which is one important field of use of light bulbs, in addition to department stores, restaurants, hotels and other business settings in which the fluorescent lamps are mainly used. Generally in fluorescent lamps, an electron radiating substance filling the electrode filament coils at the time of starting the lamp easily scatters. Accordingly, it is known that as the number of times the fluorescent lamp is lit on or off is increased, the life of the lamp is shortened. This is also true with light bulb type fluorescent lamps. Lamps which are used in houses are inevitably lit on or off a greater number of times than lamps used in business settings. It is required that the number of times the lamp can be lit on and off until the life of the lamp ends (hereinafter, the number of times the lamp can be lit on and off until the life of the lamp ends will be referred to as the "lamp life lighting on/off characteristic") be increased.

The lamp life lighting on/off characteristic is conventionally about 5000 times. Now, the lamp life lighting on/off characteristic is required to be increased to be 4 times larger, i.e., at least 20000 times. According to an experiment performed by the present inventors, the average life of the conventional lamp was 6000 hours. This corresponds to an average life obtained in a test by which the lamp is kept on for 2.5 hours and then kept off for 0.5 hours.

In order to respond to this demand, Japanese Laid-Open Publication No. 62-126596 discloses an electronic lighting circuit 140 shown in FIG. 6. A temperature positive characteristic resistance element (positive character thermistor or PCT) 133 is connected parallel to the capacitor 123 so as to be opposite to the commercial power supply 113 with respect to the fluorescent light emitting tube 120. Due to such a structure, a large amount of pre-heating electric current flows to the electrode filament coils 121 and 122 via the temperature positive characteristic resistance element 133 before the fluorescent light emitting tube 120 is started. Thus, the lamp life lighting on/off characteristic is improved.

The present inventors performed studies on a fluorescent lamp using an electronic lighting circuit, specifically a light bulb type fluorescent lamp having a built-in electronic lighting circuit, in order to realize both reduction in a power loss caused by the heat generation in an electrode filament coil in the constant lighting state of the lamp and an increase in the lamp life lighting on/off characteristic. As a result, the present inventors found that the electronic lighting circuits shown in FIGS. 5A through 5C have an undesirable possibility that the lamp life lighting on/off characteristic is not increased.

In the cold cathode starting system shown in FIG. 5A with no emission of thermoelectrons, the power loss caused by the heat generation in the coils can sufficiently be reduced. However, the voltage for starting the fluorescent light emitting tube 120 needs to be applied for an extended period of time. Thus, the glow discharge time period, immediately after the fluorescent light emitting tube 120 is started, is also relatively long. As a result, the electron radiating substance filling the electrode filament coils 121 and 122 scatters more violently than in a circuit adopting the usual hot cathode starting system, and therefore there is an undesirable possibility of reducing the lamp life lighting on/off characteristic.

In the structure shown in FIG. 5B including the diodes 128 and 129 connected parallel to the electrode filament coils 121 and 122 respectively and the structure shown in FIG. 5C including the capacitors 131 and 132 connected parallel to the electrode filament coils 121 and 122 respectively, the effect of reducing the power loss is relatively small. Moreover, a sufficient number of thermoelectrons are not emitted since a sufficient amount of pre-heating electric current does not flow to the electrode filament coils 121 and 122 before the fluorescent light emitting tube 120 is started. As a result, a larger amount of electron radiating substance scatters, which involves an undesirable possibility of not increasing the lamp life lighting on/off characteristic.

In the structure shown in FIG. 6, a sufficient amount of pre-heating electric current can flow to the electrode filament coils 121 and 122 before an electric current for starting the fluorescent light emitting tube 120 flows, which significantly increases the lamp life lighting on/off characteristic. However, the power loss caused by the heat generation in the electrode filament coils 121 and 122 during the constant light state of the fluorescent light emitting tube 120 is not reduced. The power loss is almost the same as that in the conventional electronic lighting circuit 119 shown in FIG. 4.

SUMMARY OF THE INVENTION

A light bulb type fluorescent lamp lighting apparatus according to the present invention includes a fluorescent light emitting tube; and an electronic lighting circuit for applying an electric current to the fluorescent light emitting tube. The electronic lighting circuit includes a pair of electrode filaments provided in the fluorescent light emitting tube, a capacitor connected parallel to the fluorescent light emitting tube, an inductor connected in series to one of the pair of electrode filaments, a temperature positive characteristic resistance element connected parallel to the capacitor, and at least one temperature negative characteristic resistance element connected parallel to at least one of the pair of electrode filaments.

In one embodiment of the invention, the number of the at least one temperature negative characteristic resistance element is two, and the two temperature negative characteristic resistance elements are respectively connected parallel to the pair of electrode filaments.

In one embodiment of the invention, the at least one temperature negative characteristic resistance element is connected to either one of the pair of electrode filaments.

In one embodiment of the invention, the electronic lighting circuit further includes an inverter circuit section for supplying an electric current for lighting up the fluorescent emitting tube.

A light bulb type fluorescent lamp lighting apparatus according to the present invention includes a fluorescent light emitting tube; and an electronic lighting circuit for applying an electric current to the fluorescent light emitting tube. The electronic lighting circuit includes a pair of electrode filaments provided in the fluorescent light emitting tube, a capacitor connected parallel to the fluorescent light emitting tube, an inductor connected in series to one of the pair of electrode filaments, and at least one temperature negative characteristic resistance element connected parallel to at least one of the pair of electrode filaments. The at least one temperature negative characteristic resistance element has a resistance impedance, and the fluorescent light emitting tube is started based on a change in the resistance impedance of the at least one temperature negative characteristic resistance element.

In one embodiment of the invention, the number of the at least one temperature negative characteristic resistance element is two, and the two temperature negative characteristic resistance elements are respectively connected parallel to the pair of electrode filaments.

In one embodiment of the invention, the at least one temperature negative characteristic resistance element is connected to either one of the pair of electrode filaments.

In one embodiment of the invention, the electronic lighting circuit further includes a temperature positive characteristic resistance element connected parallel to the capacitor.

In one embodiment of the invention, the electronic lighting circuit further includes an inverter circuit section for supplying an electric current for lighting up the fluorescent emitting tube.

Thus, the invention described herein makes possible the advantages of providing a fluorescent lamp lighting apparatus for reducing a power loss caused by heat generation in an electrode filament coil during a constant lighting state of a fluorescent light emitting tube and also increasing a lamp life lighting on/off characteristic.

These and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of illustrative examples with reference to the accompanying drawings.

EXAMPLE 1

Figure 1:
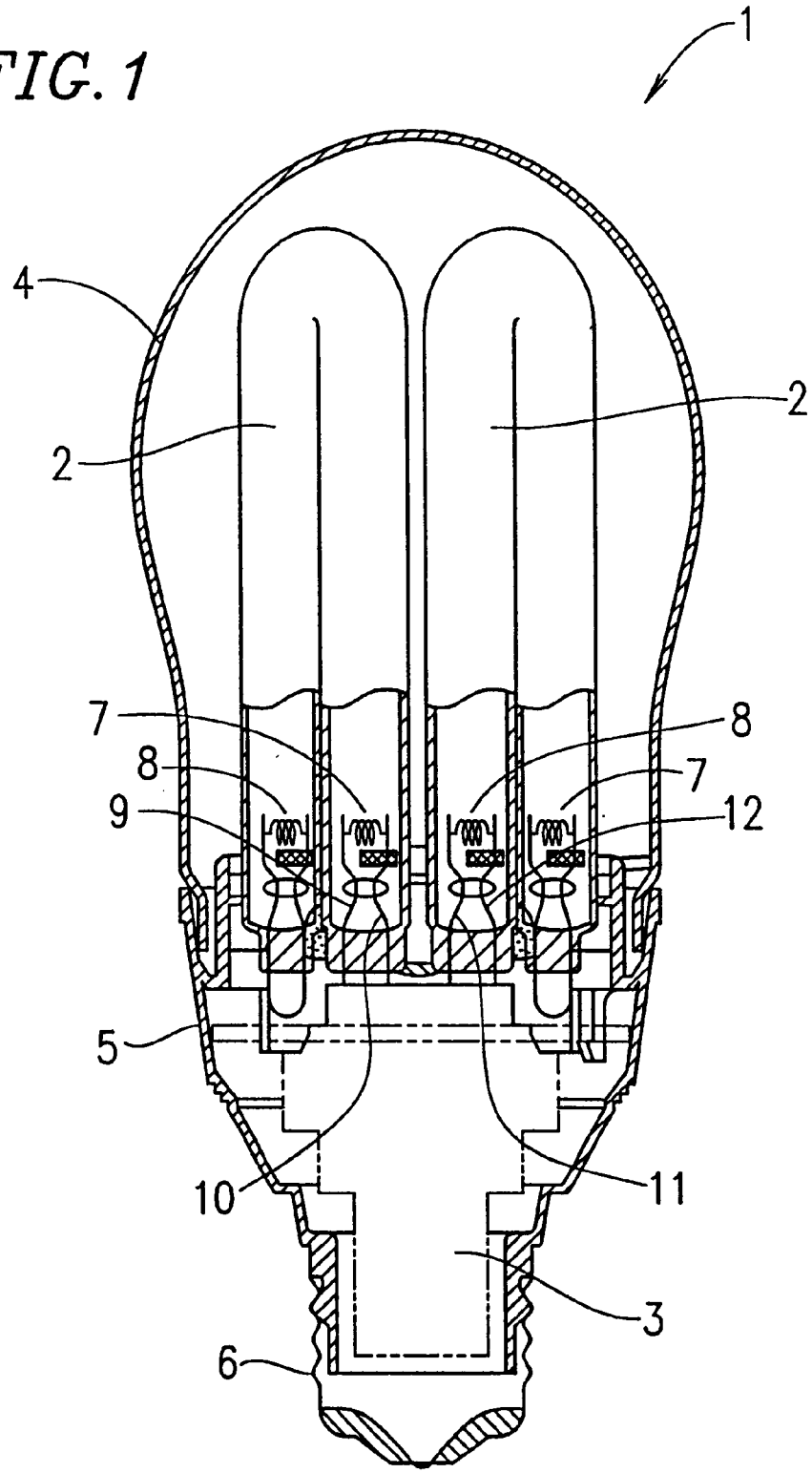
FIG. 1 is a cross-sectional view of a light bulb type fluorescent lamp lighting apparatus according to a first example of the present invention.

FIG. 1 is a cross-sectional view of a 22 W light bulb type fluorescent lamp lighting apparatus 1 according to a first example of the present invention.

The light bulb type fluorescent lamp lighting apparatus 1 includes four fluorescent light emitting tubes 2, an outer glass bulb 4 for covering the four fluorescent light emitting tubes 2, a resin case 5 connected to a base end of the outer glass bulb 4, an electronic lighting circuit 3 generally accommodated in the resin case 5, and a base 6 attached to a base end of the resin case 5. The number of the fluorescent light emitting tubes 2 is not limited to four, but can be any integral number of one or greater.

The fluorescent light emitting tubes 2 are each a U-shaped glass tube, and the four fluorescent light emitting tubes 2 are connected in series so as to form one discharge path. Each fluorescent light emitting tube 2 substantially accommodates a pair of electrode filament coils 7 and 8. The fluorescent light emitting tube 2 can accommodate any type of filaments which can emit thermoelectrons when an electric current flows therein; for example, the electrode filament coils 7 and 8 as described in this example.

The electrode filament coil 7 is supported in one end portion of each fluorescent light emitting tube 2 by a pair of leads 9 and 10. The electrode filament coil 8 is supported in the other end portion of each fluorescent light emitting tube 2 by a pair of leads 11 and 12. The electrode. filament coils 7 and 8 of each fluorescent light emitting tube 2 are extended outside the fluorescent light emitting tube 2 in the form of the leads 9 through 12, so that the electronic lighting circuit 3 generally accommodated in the resin case 5 also includes the electrode filament coils 7 and 8.

Each fluorescent light emitting tube 2 accommodates a main amalgam element (Bi—Pb—Sn—Hg granules) and an assisting amalgam element (In-plated stainless mesh), and also contains argon gas sealed therein as a buffering gas. The electrode filament coils 7 and 8 each have three turns, which is suitable to improve the lamp life lighting on/off characteristic. Each fluorescent light emitting tube 2 is also filled with a usual Ba—Ca—Sr—O-based electron radiating substance. A main portion of an inner wall of each fluorescent light emitting tube 2 is coated with a three-colored rare earth fluorescent material for emitting red, green and blue light.

Each fluorescent light emitting tube 2 has, for example, an outer diameter of about 10.7 mm and an inter-electrode distance of about 490 mm.

The electronic lighting circuit 3 is of a series inverter circuit system type, and has a circuit conversion efficiency of about 91%. The electronic lighting circuit 3 is connected to a commercial power supply (not shown in FIG. 1) via the base 6 which is attached to the base end of the resin case 5.

Figure 2:
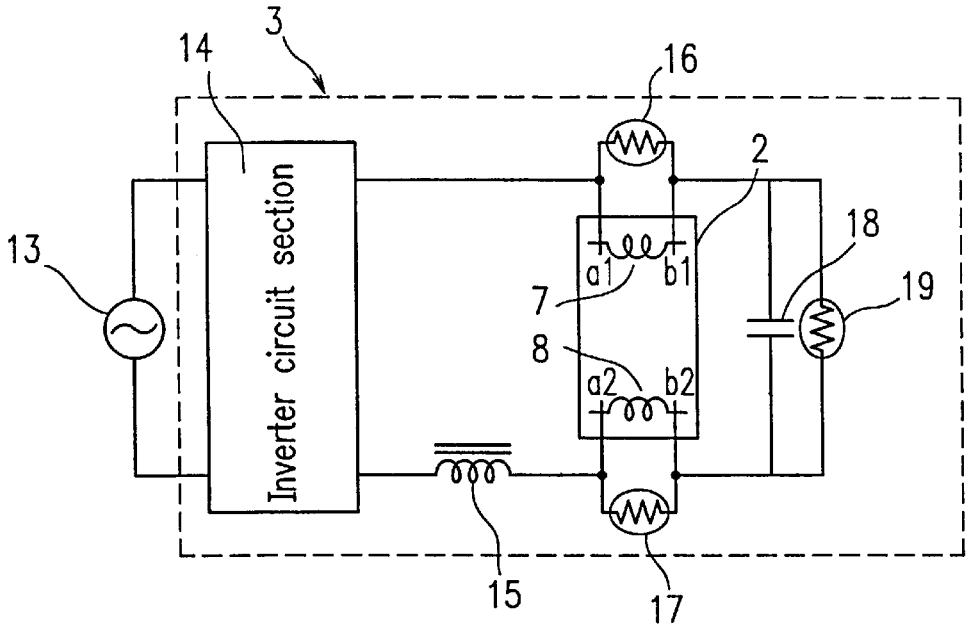
FIG. 2 is a circuit diagram illustrating a structure of an electronic lighting circuit used in the light bulb type fluorescent lamp lighting apparatus shown in FIG. 1.

FIG. 2 is a circuit diagram illustrating a structure of the electronic lighting circuit 3.

The electronic lighting circuit 3 includes the electrode filament coils 7 and 8, an inverter circuit section 14, an inductor 15, temperature negative characteristic resistance elements (negative character thermistors or NCTs) 16 and 17, a capacitor 18, and a temperature positive characteristic resistance element (positive character thermistor or PCT) 19. The electrode filament coil 7 has terminals a1 and b1, and the electrode filament coil 8 has terminals a2 and b2. The terminals a1 and a2 are closer than the terminals b1 and b2 to a commercial power supply 13 for applying an electric current to the fluorescent light emitting tube 2.

The inverter circuit section 14 which is driven by the commercial power supply 13 lights up the fluorescent light emitting tube 2. The terminal a1 of the electrode filament coil 7 is directly connected to the inverter circuit section 14, and the terminal a2 of the electrode filament coil 8 is connected to the inverter circuit section 14 via the inductor 15 provided for electric current control. The inductor 15 is connected in series to the terminal a2.

The capacitor 18 and the temperature positive characteristic resistance element 19 are connected parallel to each other between the terminal b1 of the electrode filament coil 7 and the terminal b2 of the electrode filament coil 8.

The temperature negative characteristic resistance element 16 is connected between the terminals a1 and b1 of the electrode filament coil 7, and the temperature negative characteristic resistance elements 17 is connected between the terminals a2 and b2 of the electrode filament coil 8.

An operation of the electronic lighting circuit 3 having the above-described structure will be described. Specifically, a starting process operation for pre-heating and thus placing the fluorescent light emitting tube 2 into a constant lighting state will be described in detail. In more detail, by the starting process operation, a switch of the light bulb type fluorescent lamp lighting apparatus 1 is turned on to cause the commercial power supply 13 to supply an AC current, and then a starting voltage is applied to the electrode filament coils 7 and 8 of each fluorescent light emitting tube 2.

The temperature positive characteristic resistance element 19 has a relatively low temperature before the fluorescent light emitting tube 2 is started. Therefore, the resistance impedance of the temperature positive characteristic resistance element 19 is relatively low. Such a low resistance impedance of the temperature positive characteristic resistance element 19 offers the following advantages.

(1) The electric current for pre-heating the electrode filament coils 7 and 8 mainly flows through the temperature positive characteristic resistance element 19 having the low resistance impedance, rather than the capacitor 18. This allows the pre-heating current to be set at a relatively high value. Therefore, the electrode filament coils 7 and 8 can be efficiently pre-heated within a time period of as short as 1 second before the fluorescent light emitting tube 2 is started. Thus, a sufficient amount of thermoelectrons can be emitted.

As a result, the fluorescent light emitting tube 2 is started rapidly by applying the starting voltage for only a short period. Thus, the glow discharge time period, immediately after the fluorescent light emitting tube 2 is started, is shortened. As a result, the scattering of the electron radiating substance filling the electrode filament coils 7 and 8 is restricted during the starting process. Since the electrode filament coils 7 and 8 are pre-heated before the fluorescent light emitting tube 2 is started, the problem that, a larger amount of electron radiating substance scatters by applying the starting voltage to the electrode filament coils 7 and 8, is avoided. Therefore, the lamp life lighting on/off characteristic is increased.

(2) Before the fluorescent light emitting tube 2 is started, the temperature negative characteristic resistance elements 16 and 17 respectively connected parallel to the electrode filament coils 7 and 8 each have a relatively low temperature and a relatively high resistance impedance. Thus, the pre-heating current mostly flows into the electrode filament coils 7 and 8.

The above-described action of the temperature positive characteristic resistance element 19 and the temperature negative characteristic resistance elements 16 and 17 contributes to efficient pre-heating of the electrode filament coils 7 and 8 and thus to emission of a sufficient amount of thermoelectrons even within a short period of time of 1 second before the fluorescent light emitting tube 2 is started. In addition, since the resistance impedance of the temperature positive characteristic resistance element 19 is relatively low before the fluorescent light emitting tube 2 is started, a resonating voltage is not generated in the capacitor 18 by the so-called resonating phenomenon caused by the inductor 15 and the capacitor 18. Therefore, no starting voltage is applied to the fluorescent light emitting tube 2.

The above-mentioned time period of within 1 second before the fluorescent light emitting tube 2 is started is required for a light bulb type fluorescent lamp lighting apparatus 1 to be used instead of a general bulb having a feature of being instantaneously lit up. The time period is usually set to be 0.6 to 0.8 seconds.

The resistance impedance of the temperature positive characteristic resistance element 19 is rapidly increased as the temperature increases due to the Joule heat generated by the pre-heating current. Due to the resonating phenomenon caused by the inductor 15 and the capacitor 18, a starting voltage corresponding to the resonating voltage of the capacitor 18 is applied between the electrode filament coils 7 and 8. Thus, the fluorescent light emitting tube 2 is started.

During this process, the temperature of each of the temperature negative characteristic resistance elements 16 and 17 is increased and thus the resistance impedance thereof is lowered. This results in the electrode filament coils 7 and 8 each being shortcircuited. Therefore, a starting voltage corresponding to the resonating voltage of the capacitor 18 is more rapidly increased than in a structure which does not include the temperature negative characteristic resistance element 16 or 17. For this reason, the fluorescent light emitting tube 2 is started by applying the starting voltage for a shorter time period. Thus, the lamp life lighting on/off characteristic is improved by providing the temperature negative characteristic resistance elements 16 and 17.

During the constant lighting state immediately after the fluorescent light emitting tube 2 is started, the temperature negative characteristic resistance elements 16 and 17 each still have a relatively high temperature and a relatively low resistance impedance. Therefore, the current flowing via the capacitor 18 mostly flows into the temperature negative characteristic resistance elements 16 and 17, not the electrode filament coils 7 and 8. Thus, the power loss caused by the heat generation in the electrode filament coils 7 and 8 is reduced during the constant lighting state.

The light bulb type fluorescent lamp lighting apparatus 1 according to the present invention including the electronic lighting circuit 3 was tested for the power of the electrode filament coils and the lamp life lighting on/off characteristic. The lamp life lighting on/off characteristic was measured by repeating the cycle of keeping the fluorescent light emitting tubes 2 on for 10 seconds and keeping the tubes 2 off for 170 seconds. The tubes 2 were kept off for 170 seconds since 170 seconds was required to cool down the temperature negative characteristic resistance elements 16 and 17. The power and the lamp life lighting on/off characteristic was found by averaging the values obtained with five samples of the light bulb type fluorescent lamp lighting apparatus 1 tested.

The light bulb type fluorescent lamp lighting apparatus 1 exhibited a power of 22.1 W and a luminous flux of 1520 lm.

For comparison, the same test was performed for a light bulb type fluorescent lamp lighting apparatus excluding the temperature negative characteristic resistance elements 16 and 17. The light bulb type fluorescent lamp lighting apparatus used for the comparative test exhibited a power of 23.0 W and a luminous flux of 1510 lm. The provision of the temperature negative characteristic resistance elements 16 and 17 results in reduction in the power loss of about 0.9 W.

The light bulb type fluorescent lamp lighting apparatus 1 according to the present invention including the electronic lighting circuit 3 showed a lamp life lighting on/off characteristic of 23550 times, whereas the light bulb type fluorescent lamp lighting apparatus excluding the temperature negative characteristic resistance elements 16 and 17 showed a lamp life lighting on/off characteristic of 17540 times. The light bulb type fluorescent lamp lighting apparatus excluding the temperature positive characteristic resistance element 19 as well as the temperature negative characteristic resistance elements 16 and 17 showed a lamp life lighting on/off characteristic of 6950 times. As can be appreciated, the electronic lighting circuit 3 significantly improves the lamp life lighting on/off characteristic by including the temperature negative characteristic resistance elements 16 and 17. By a synergistic effect of combining the temperature negative characteristic resistance elements 16 and 17 with the temperature positive characteristic resistance element 19, the intended lamp life lighting on/off characteristic of at least 20000 times was realized.

EXAMPLE 2

Figure 3:
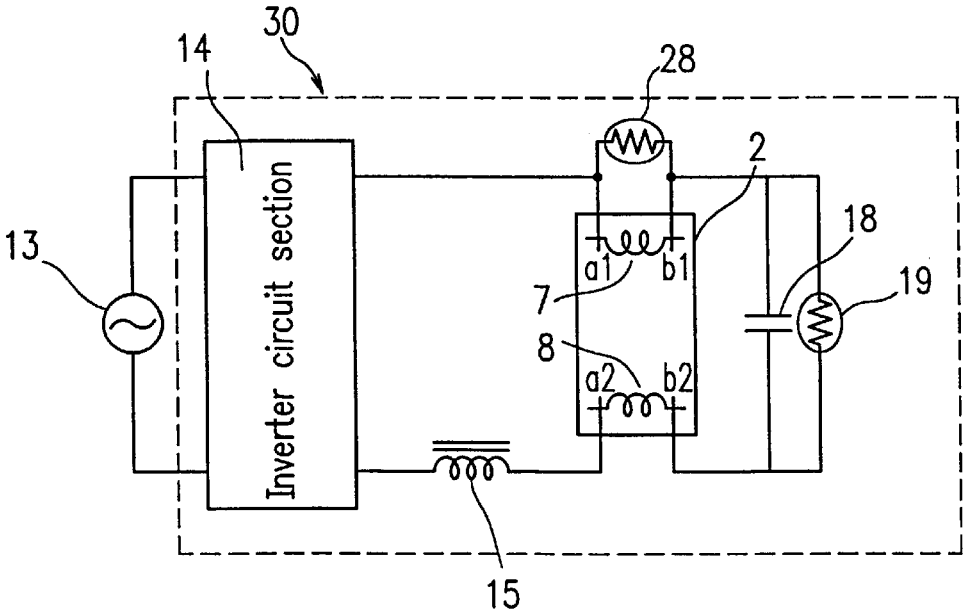
FIG. 3 is a circuit diagram illustrating a structure of an electronic lighting circuit used in a light bulb type fluorescent lamp lighting apparatus according to a second example of the present invention.
Figure 4:
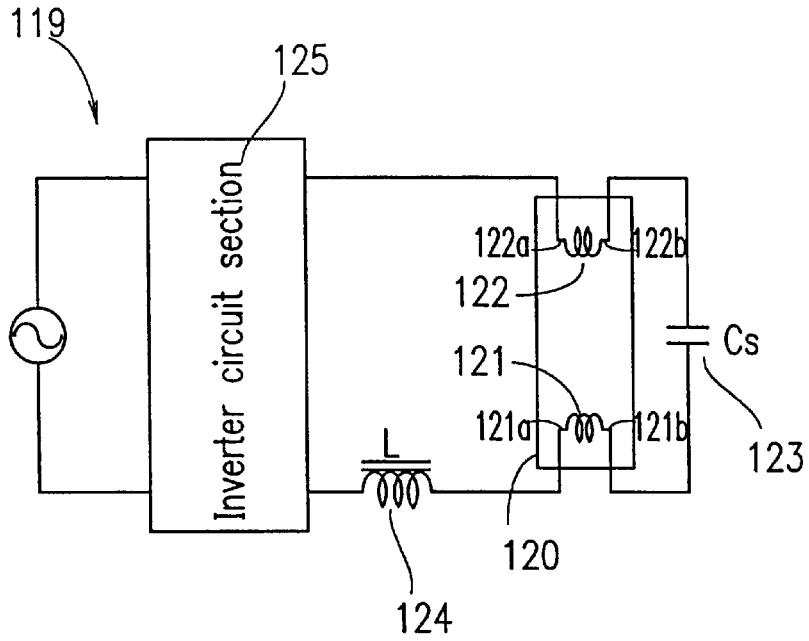
FIG. 4 is a circuit diagram illustrating a basic structure of a conventional electronic lighting circuit.
Figure 5A:
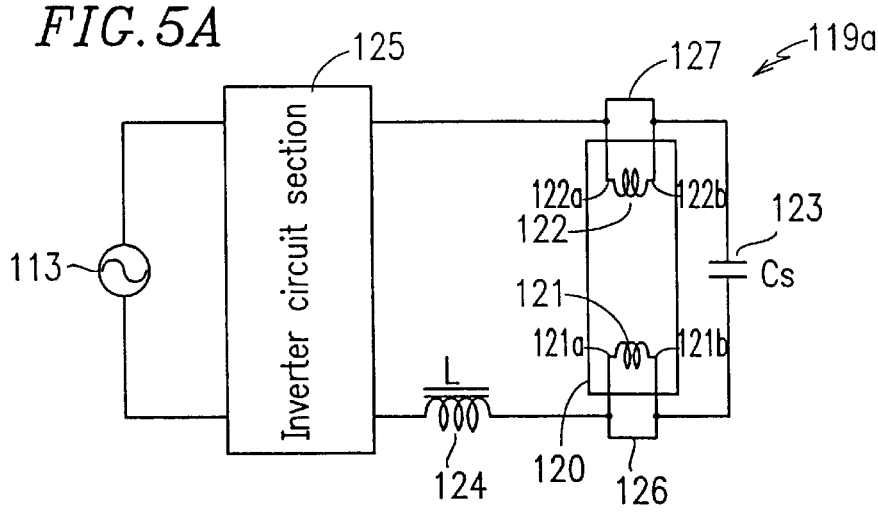
FIGS. 5A through 5C are each a circuit diagram of a conventional electronic light circuit proposed for reducing a power loss caused by heat generation in an electrode filament coil of a fluorescent lamp lighting apparatus.
Figure 5B:
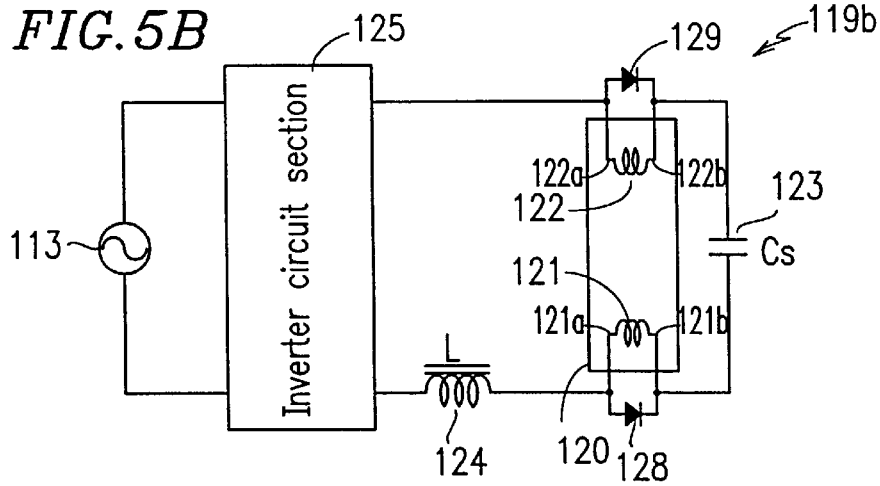
Figure 5C:
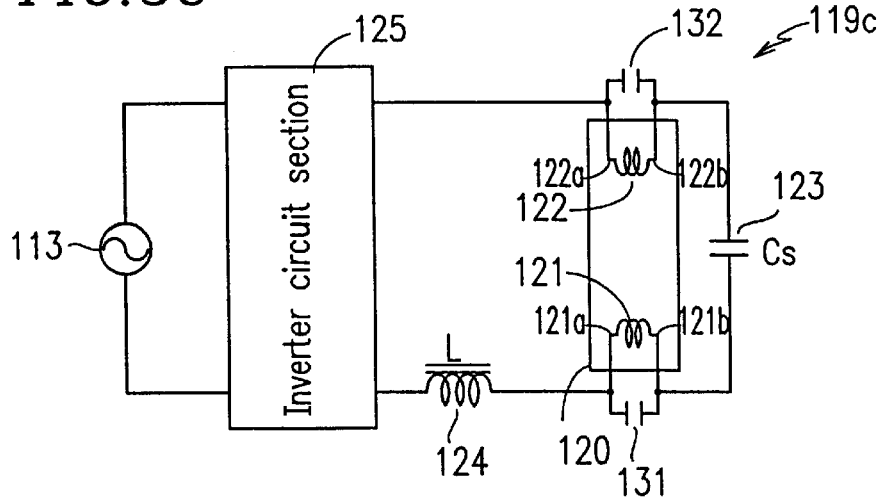
Figure 6:
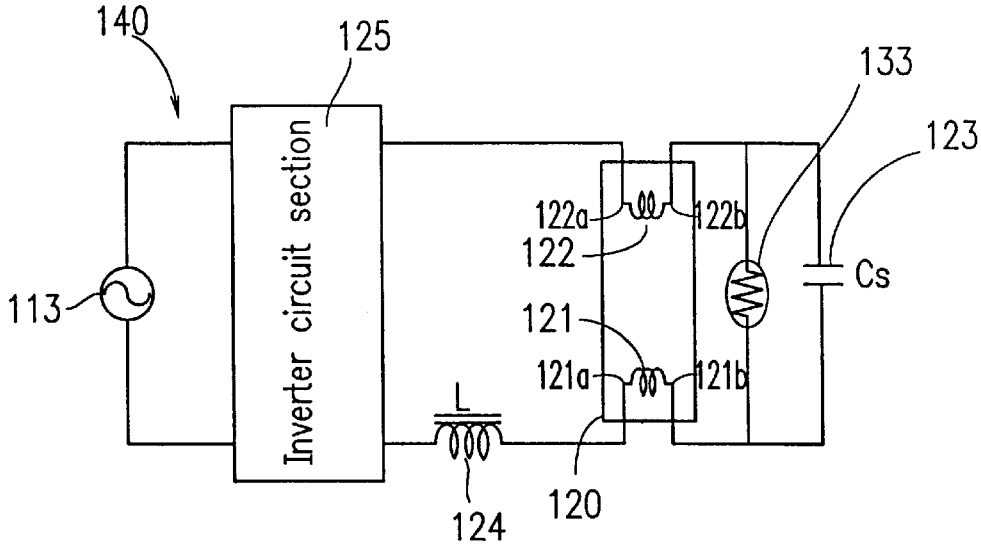
FIG. 6 is a circuit diagram of a conventional electronic light circuit proposed for improving a lamp life lighting on/off characteristic.

FIG. 3 is a circuit diagram illustrating a structure of an electronic lighting circuit 30 used in a light bulb type fluorescent lamp lighting apparatus according to a second example of the present invention. Except for the electronic lighting circuit 30, the light bulb type fluorescent lamp lighting apparatus in the second example has the same structure as that of the light bulb type fluorescent lamp lighting apparatus 1 shown in FIG. 1 and will not be described in detail.

The electronic lighting circuit 30 is different from the electronic lighting circuit 3 shown in FIG. 2 in that one temperature negative characteristic resistance element 28, instead of two, is connected parallel to the electrode filament coil 7. Except for this point, the electronic lighting circuit 30 has the same structure as that of the electronic lighting circuit 3 shown in FIG. 2, and operates in a similar manner for starting and thus placing the fluorescent light emitting tube 2 into a constant lighting state.

The light bulb type fluorescent lamp lighting apparatus according to the present invention including the electronic lighting circuit 30 was tested for the power of the electrode filament coils and the lamp life lighting on/off characteristic. The test was performed in a similar manner to that in the first example. The light bulb type fluorescent lamp lighting apparatus exhibited a power of 22.6 W and a luminous flux of 1520 lm.

For comparison, the same test was performed for a light bulb type fluorescent lamp lighting apparatus excluding the temperature negative characteristic resistance element 28. The light bulb type fluorescent lamp lighting apparatus used for the comparative test exhibited a power of 23.0 W and a luminous flux of 1510 lm. The provision of the temperature negative characteristic resistance element 28 results in reduction in the power loss of about 0.4 W.

The light bulb type fluorescent lamp lighting apparatus according to the present invention including the electronic lighting circuit 30 showed a lamp life lighting on/off characteristic of 21550 times, whereas the light bulb type fluorescent lamp lighting apparatus lighting apparatus excluding the temperature negative characteristic resistance element 28 showed a lamp life lighting on/off characteristic of 17540 times. As can be appreciated, the electronic lighting circuit 30 can significantly improve the lamp life lighting on/off characteristic by including only one temperature negative characteristic resistance element 28. By a synergistic effect of combining the temperature negative characteristic resistance element 28 with the temperature positive characteristic resistance element 19, the intended lamp life lighting on/off characteristic of at least 20000 times was realized.

In the case where the electronic lighting circuit 30 is used, when the fluorescent light emitting tube 2 is turned off and then turned on within 2 minutes to maintain the temperature of each of the temperature negative characteristic resistance element 28 and the temperature positive characteristic resistance element 19 high, the electrode filament coil 8 which is not connected to any temperature negative characteristic resistance element is pre-heated. Therefore, even under the condition that the fluorescent light emitting tube 2 is turned on and off frequently, the electron radiating substance does not scatter so violently as to deteriorate the lamp life lighting on/off characteristic.

Japanese Patent No. 2839177 discloses an electronic lighting circuit for a fluorescent lamp lighting apparatus including a temperature negative characteristic resistance element connected parallel to each of two electrode filament coils respectively provided at two ends of a light emitting tube, which is similar to the structure of FIG. 2 of the present invention. However, the technology disclosed in Japanese Patent No. 2839177 has a different technological idea from that of the present invention as described below.

In Japanese Patent No. 2839177, the temperature negative characteristic resistance elements are provided in order to prevent abnormal heat generation at the ends of the fluorescent lamp lighting apparatus after the electrode filament coils are broken at the end of the life of the fluorescent lamp lighting apparatus. When the fluorescent light emitting tube is started or during a constant light state of the fluorescent light emitting tube, the temperature of the temperature negative characteristic resistance elements is kept low and the resistance impedance thereof is kept high. Accordingly, the technology disclosed in Japanese Patent No. 2839177 does not provide the effects of the present invention, i.e., improvement in the lamp life lighting on/off characteristic and reduction in the power loss caused by heat generation in the electrode filament coil during the constant light state.

In the above examples, the electronic lighting circuit includes the inverter circuit section, but the inverter circuit section can be provided outside the electronic lighting circuit so long as the electronic lighting circuit receives an AC current.

As described above, the present invention provides a light bulb type fluorescent lamp lighting apparatus including at least one temperature negative characteristic resistance element connected parallel to an electrode filament coil of a fluorescent light emitting tube. Due to such a structure, the present invention reduces the power loss caused by heat generation in an electrode filament coil during a constant light state of the fluorescent light emitting tube and improves a lamp life lighting on/off characteristic.

A fluorescent lamp lighting apparatus according to the present invention includes a temperature negative characteristic resistance element connected parallel to at least one of the electrode filament coils of a fluorescent light emitting tube. Thus, the power loss caused by heat generation in the electrode filament coil during a constant light state of the fluorescent light emitting tube is reduced, and the lamp life lighting on/off characteristic is improved.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A light bulb type fluorescent lamp lighting apparatus, comprising:

a fluorescent light emitting tube; and an electronic lighting circuit for applying an electric current to the fluorescent light emitting tube, wherein the electronic lighting circuit includes:

a pair of electrode filaments provided in the fluorescent light emitting tube, a capacitor connected parallel to the fluorescent light emitting tube, an inductor connected in series to one of the pair of electrode filaments, a temperature positive characteristic resistance element connected parallel to the capacitor, and at least one temperature negative characteristic resistance element connected parallel to at least one of the pair of electrode filaments, wherein the at least one temperature negative characteristic resistance element has a resistance impedance which is lowered as the temperature of the at least one temperature negative characteristic resistance element increases.

2. A light bulb type fluorescent lamp lighting apparatus according to claim 1, wherein the number of the at least one temperature negative characteristic resistance element is two, and the two temperature negative characteristic resistance elements are respectively connected parallel to the pair of electrode filaments.

3. A light bulb type fluorescent lamp lighting apparatus according to claim 1, wherein the at least one temperature negative characteristic resistance element is connected to either one of the pair of electrode filaments.

4. A light bulb type fluorescent lamp lighting apparatus according to claim 1, wherein the electronic lighting circuit further includes an inverter circuit section for supplying an electric current for lighting up the fluorescent emitting tube.

5. A light bulb type fluorescent lamp lighting apparatus, comprising:

a fluorescent light emitting tube; and an electronic lighting circuit for applying an electric current to the fluorescent light emitting tube, wherein the electronic lighting circuit includes:

a pair of electrode filaments provided in the fluorescent light emitting tube, a capacitor connected parallel to the fluorescent light emitting tube, wherein the electronic lighting circuit further includes a temperature positive characteristic resistance element connected parallel to the capacitor, an inductor connected in series to one of the pair of electrode filaments, and at least one temperature negative characteristic resistance element connected parallel to at least one of the pair of electrode filaments, wherein the at least one temperature negative characteristic resistance element has a resistance impedance which is lowered as the temperature of the at least one temperature negative characteristic resistance element increases, and the fluorescent light emitting tube is started based on a change in the resistance impedance of the at least one temperature negative characteristic resistance element.

6. A light bulb type fluorescent lamp lighting apparatus according to claim 5, wherein the number of the at least one temperature negative characteristic resistance element is two, and the two temperature negative characteristic resistance elements are respectively connected parallel to the pair of electrode filaments.

7. A light bulb type fluorescent lamp lighting apparatus according to claim 5, wherein the at least one temperature negative characteristic resistance element is connected to either one of the pair of electrode filaments.

8. A light bulb type fluorescent lamp lighting apparatus according to claim 5, wherein the electronic lighting circuit further includes an inverter circuit section for supplying an electric current for lighting up the fluorescent emitting tube.

* * * * *